US006483279B1

(12) United States Patent
Pöss et al.

(10) Patent No.: US 6,483,279 B1
(45) Date of Patent: Nov. 19, 2002

(54) DEVICE FOR ATTENUATING PARASITIC VOLTAGES

(75) Inventors: Hans-Joachim Pöss, Gelnhausen (DE); Franz Wagner, Erlensee (DE)

(73) Assignee: Vacuumschmelze GmbH (DE)

( * ) Notice: Subject to any disclaimer, the term of this patent is extended or adjusted under 35 U.S.C. 154(b) by 0 days.

(21) Appl. No.: 09/807,242

(22) PCT Filed: Oct. 21, 1999

(86) PCT No.: PCT/DE99/03382

§ 371 (c)(1),
(2), (4) Date: May 30, 2001

(87) PCT Pub. No.: WO00/25329

PCT Pub. Date: May 4, 2000

(30) Foreign Application Priority Data

Oct. 22, 1998 (DE) ..... 198 48 827

(51) Int. Cl.[7] ..... G05F 1/325; G05F 1/33

(52) U.S. Cl. ..... 323/250; 323/251; 323/255; 323/362

(58) Field of Search ..... 323/250, 251, 323/255, 355, 362, 356

(56) References Cited

U.S. PATENT DOCUMENTS 5,619,174 A 4/1997 Tsuyoshi et al.
5,635,828 A * 6/1997 Yoshizawa et al. ..... 323/362
5,751,207 A 5/1998 Poess
6,031,341 A * 2/2000 Yoshizawa et al. ..... 315/276

FOREIGN PATENT DOCUMENTS

| | | |
|---|---|---|
| DE | 3112296 | 10/1982 |
| DE | 3220737 | 12/1983 |
| EP | 0635853 | 1/1995 |
| GB | 512760 | 10/1939 |

OTHER PUBLICATIONS

Patent Abstracts of Japan, vol. 015, No. 040 (E–1028), Jan. 30, 1981.

Japanese Patent Abstract 02–277203, Nov. 13, 1990.

* cited by examiner

*Primary Examiner*—Bao Q. Vu
(74) *Attorney, Agent, or Firm*—Dean W. Russell; Kilpatrick Stockton LLP

(57) ABSTRACT

A reactance coil (1) has an annular core (2) on which reactance coils are wound. Said reactance coils (3) are divided up into coil sectors 6 (4) that are separated from each other by means of gaps (5) in the windings. The gaps (5) in the windings reduce reactance coil (3) capacity and the reactance coils (3) have resonances with higher maximum values for impedance and greater bandwidths.

6 Claims, 4 Drawing Sheets

DEVICE FOR ATTENUATING PARASITIC VOLTAGES

The invention relates to a device for attenuating parasitic voltages with a magnetic core and at least one reactance coil with multiple windings wound around said magnetic core.

Such devices are generally known and are used, for instance, to suppress the storage of parasitic voltages in mains power lines through power consumers. Effective attenuation requires the choke to obtain as high an impedance as possible over as wide a frequency range as possible.

Based on this present state of the art the goal of the invention is to create a device for attenuating parasitic voltages with high impedance over a defined broad frequency range.

This goal is achieved by the invention in that along the length of each reactance coil closely wound winding sections alternate with broadly wound winding sections.

Since each reactance coil contains closely wound winding sections, the overall number of windings is high, yielding a high inductance value for the device. On the other hand the capacitance of the reactance coil is determined by the broadly wound winding sections, yielding overall a low capacitance value for each reactance coil. The consequence of both is that resonances arising from inductance and capacitance have a large bandwidth and a high peak value for impedance. Appropriate adjustment of the dimensions makes it possible to set the resonance frequencies of the device to values at which the parasitic signal spectrum shows peak levels and hence to optimize suppression of the parasitic signals.

Further design examples and advantageous constructions are given in the subordinate claims.

Figure 1:
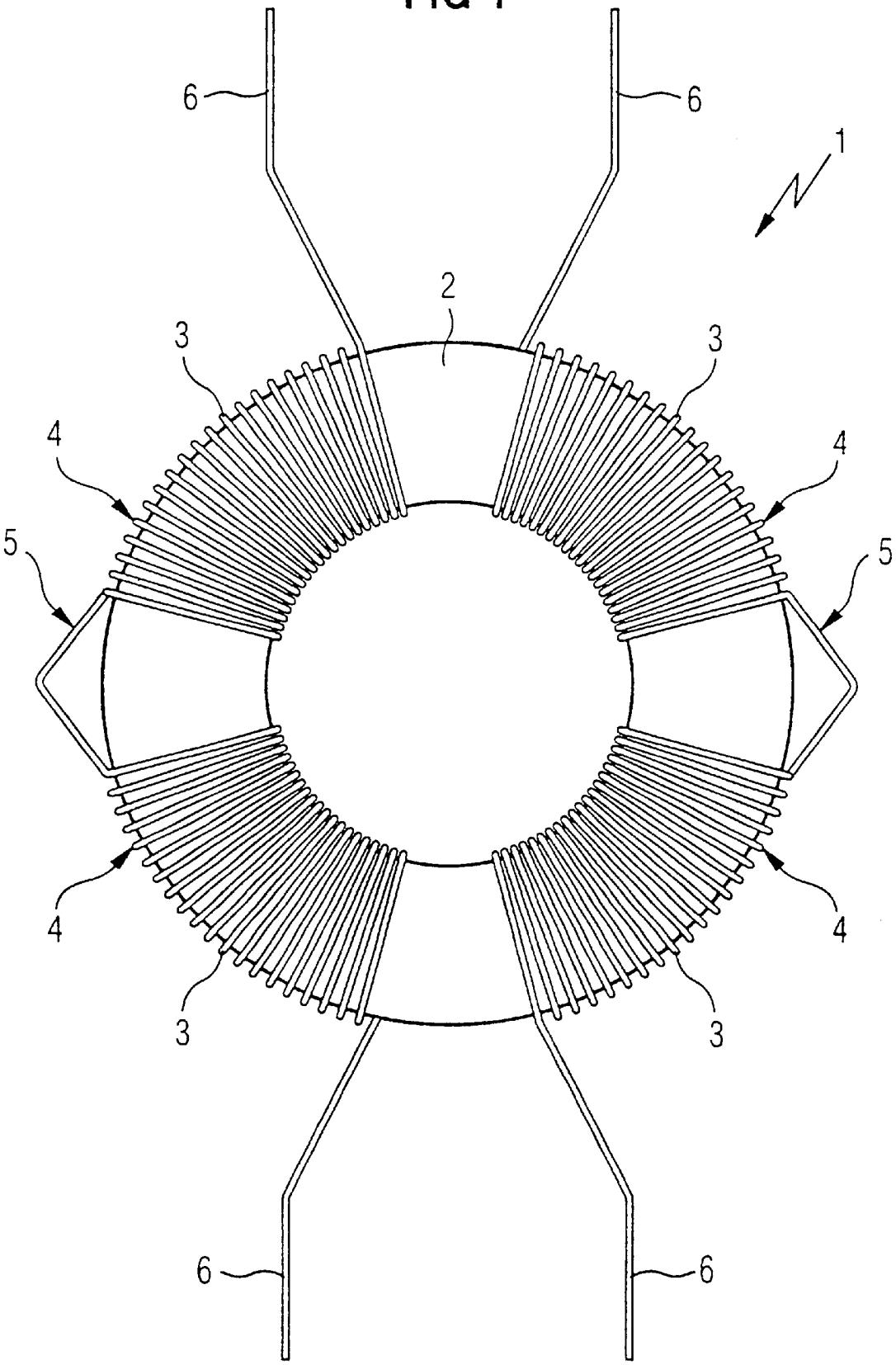
Figure 2:
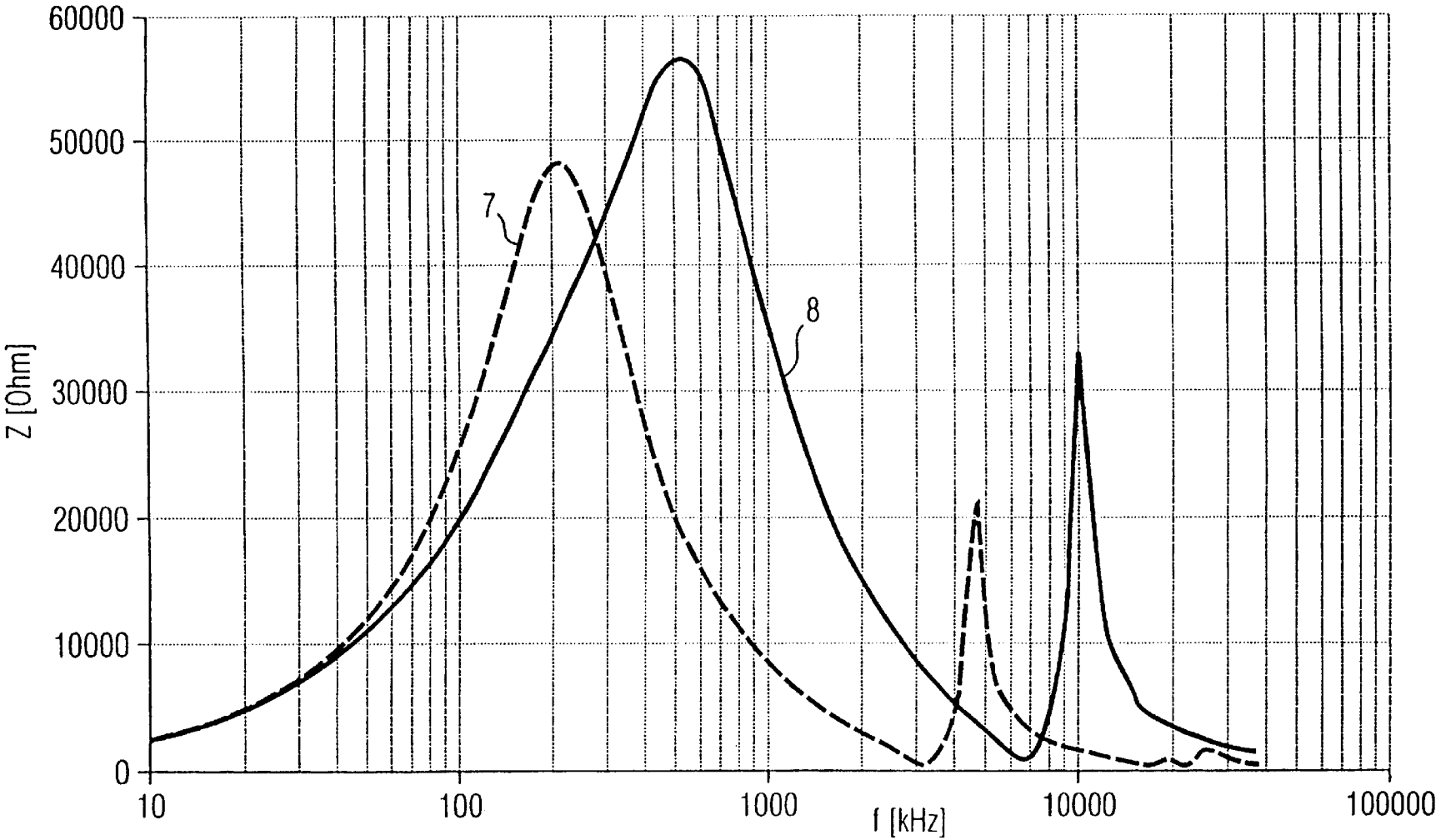
Figure 3:
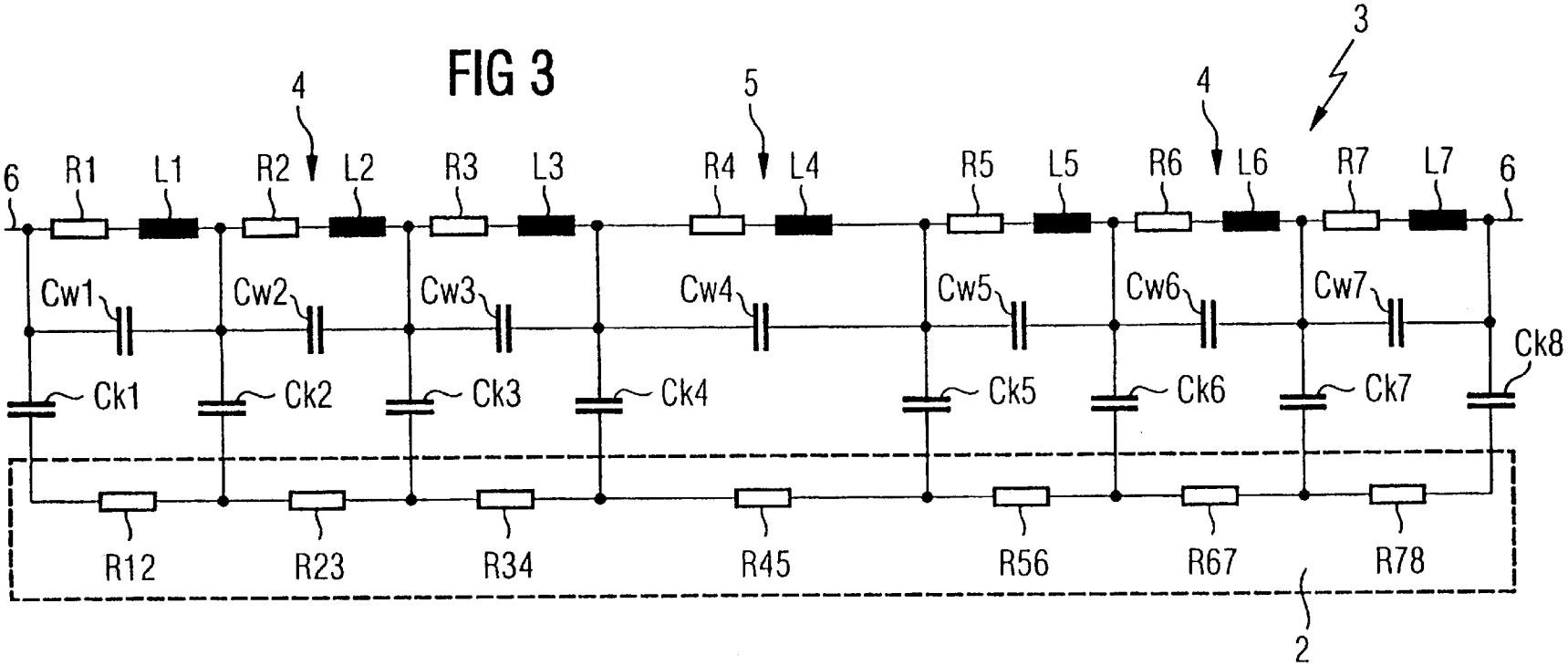
Figure 4:
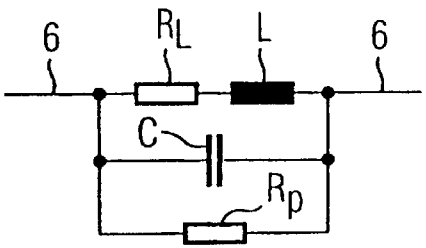

An example of a design is described in detail in the following based on the drawings which show:

FIG. 1: a view from above of a current compensated choke;

FIG. 2: the impedance sequence of the choke in FIG. 1 plotted against frequency;

FIG. 3: an equivalent circuit diagram for one of the reactance coils of the choke in FIG. 1;

FIG. 4: a schematic circuit diagram for the choke in FIG. 1; and

Figure 5:
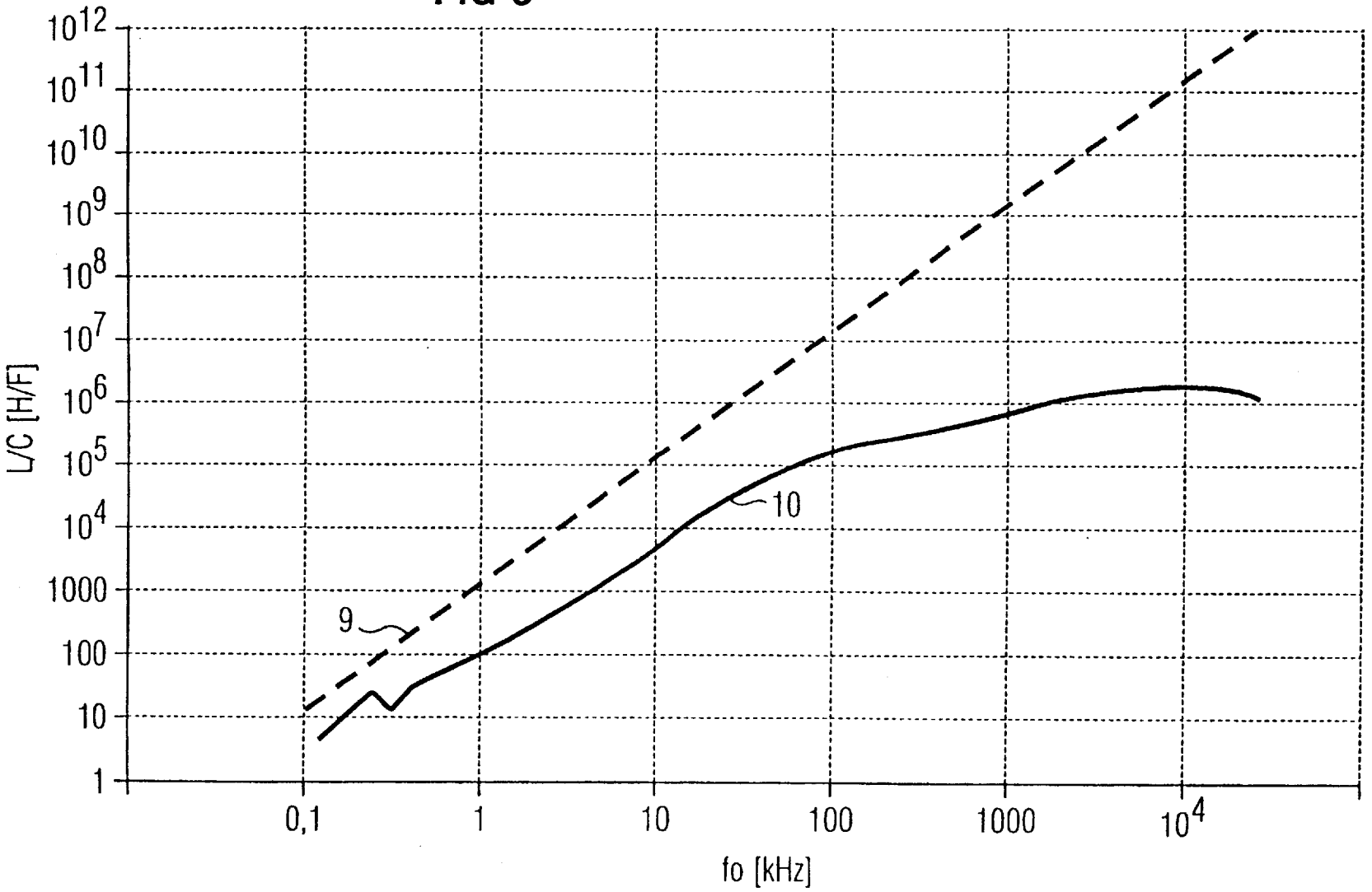

FIG. 5: a representation of the sequence of the ratio of inductance to capacitance depending upon the resonance frequency for an ideal and an actual choke.

FIG. 1 shows a current-compensated choke 1 which contains an annular core 2. Around the annular core 2 are wound reactance coils 3 which contain closely wound colt sectors 4 as well as winding gaps 5.

The current-compensated choke 1 serves to suppress asymmetrical parasitic voltages that arise in mains power lines. In so doing, the rated current of the choke 1 should not reach saturation. For this purpose the choke 1 is connected to mains power lines via connection lines 6 in such a way that the flux created from the rated current in the two reactance coils 3 is compensated to zero in the annular core 2.

Suppression of asymmetrical parasitic voltages requires the choke 1 to have as high an impedance as possible over as broad a frequency range as possible.

In FIG. 2 a dashed fine 7 indicates the impedance sequence in a choke without winding gaps 5 (not shown in the drawing). In contrast a continuous curve 8 in FIG. 2 represents the impedance sequence of the choke 1. It is clear from FIG. 2 that the impedance curve 8 has a higher impedance peak than the impedance curve 7. The resonance half-widths, too, are larger for impedance curve 8 than for impedance curve 7. Thus, in contrast to a choke without winding gaps, the choke 1 with winding gaps 5 has higher impedance values in a broader frequency range for the same number of windings and the same annular core.

This effect will be further explained with the help of FIGS. 3 through 5.

FIG. 3 shows an equivalent circuit diagram for the reactance coil 3. Inductances L1 through L3 as well as L5 through L7 represent the inductance of windings in, the coil sectors 4, in contrast to inductance 1A which represents the inductance of the winding gaps 5. Resistances R1 through R7 stand for the line resistance of the windings. Similarly capacitances CW1 through CW3 as well as CW5 through CW7 represent capacitance between adjoining windings in the coil sectors 4. Finally capacitance C4 shows the capacitance of the winding gaps 5. Moreover FIG. 3 indicates that the annular core 2 is not an insulator, as shown in FIG. 3 by resistances R12 through R78. In particular high-frequency voltage components are coupled to the annular core 2 via the capacitors CK1 through CK8.

Since capacitance CW4 of the reactance coil 3 in the region of the winding gaps 5 is significantly smaller than capacitances CW1 through CW3 as well as CW5 through CW7, the capacitance of the reactance coil 3 is essentially equal to that of capacitance CW4 of the reactance coil 3 in the winding gaps 5. The inductance of the reactance coil 3, however, is equal to the sum of inductances L1 through L7.

The effect caused by the reduction of capacitance CW4 can now be explained based upon the schematic circuit diagram shown in FIG. 4.

In FIG. 4, inductance L stands for the sum of inductances L1 through L7 in FIG. 3. In FIG. 4 a line resistance $R_L$ is shown in front of inductance L. A capacitance C is connected in parallel to said resistance. The value of capacitance C essentially corresponds to the value of capacitance CW4 from FIG. 3. Moreover connected in parallel to resistance $R_L$ and inductance L of the reactance coil 3 is an impedance $R_P$ which indicates the current path leading over the annular core 2.

The schematic circuit diagram shown in FIG. 4 is the schematic circuit diagram of a dissipative parallel resonance circuit. In the case where $R_P$ is significantly larger than $R_L$, the bandwidth is given by:

$$\frac{\Delta f}{f_0} = R_L\sqrt{\frac{C}{L}} + \frac{1}{R_P}\sqrt{\frac{L}{C}} \tag{1}$$

where $\Delta f$ is the bandwidth and $f_0$ is the resonance frequency. This has the consequence that, at least with vanishing line resistance $R_L$ and finally parallel resistance $R_P$, the bandwidth increases with the growth in ratio of inductance L to capacitance C. Hence a large bandwidth requires the inductance of the reactance coil 3 to be as large as possible and capacitance C of the reactance coil 3 to be as small as possible.

Impedance at the resonance frequency on condition that $R_P$ is very much larger than $R_L$ is given by the formula:

$$R_o = \frac{\frac{L}{C}}{R_L + \frac{1}{R_P}\cdot\frac{L}{C}} \tag{2}$$

It is clear from this formula that the resonance resistance also increases with the growth in ratio of inductance L to capacitance C. Hence obtaining large peak values for impedance at resonance frequencies requires inductance L to be as large as possible and capacitance C to be as small as possible.

It is also clear from the two formulas that the effect described of simultaneous increase in bandwidth and resonance resistance occurs only if the parallel resistance $R_P$ does not reach too high a value. Since the specific resistance of ferrites is significantly larger than the specific resistance of soft-magnetic nanocrystalline alloys, the effects described are significantly weaker for reactance coils equipped with ferrite cores. By soft-magnetic nanocrystalline alloy is meant, for example, alloys known from EP 0271657 B1.

Finally FIG. 5 shows how the ratio of L to C develops if for a given reactance coil the resonance frequency $f_0$ is increased by lowering capacitance C. Thus in FIG. 5 a dashed line 9 represents the ideal case of an inductance that is not frequency-dependent, while the continuous curve 10 was calculated from measured data for the inductance of a reactance coil. FIG. 5 shows a double logarithmic representation of the straight-line climb of the ratio of the ideal frequency-independent inductance L to capacitance C. The curve calculated from measured data follows a path generally parallel to the ideal curve 9 between 100 Hz and 30 kHz. Thereafter, owing to the reduction in inductance at higher frequencies, it flattens out above 30 kHz and finally falls off for frequencies above 10 MHz. Up to this upper limit it is possible in the case of the measured reactance coil 3 to reduce the capacitance of the reactance coil 3 by forming a winding gap 5 and thus to increase the peak value and bandwidth of the resonances.

Appropriate adjustment of dimensions for the number of windings and for the coil sectors 4 makes it possible to set up resonances in the reactance coil 3 in frequency ranges in which the parasitic signals have strong frequency components and in this way to cause effective suppression of parasitic signals occurring in this frequency range.

It should be noted, however, that the reactance coil 3 is short-circuited through the annular core 2, especially at high frequencies. This can be avoided by having the coil sectors 4 arranged in multiple layers and in extreme cases replaced by bundled windings. Owing to the greater distance from the core the outer layers of the bundled winding no longer couple in a capacitance sense with the annular core 2. Hence the reactance coil 3 is not short-circuited through the annular core 2, even at high frequencies. Use of bundled windings, moreover, yields a reactance coil with greater inductance at simultaneously very low capacitance.

It should be noted that the above explanations are not limited to dual-phase current-compensated chokes but also apply without restriction to chokes with three or more phases.

What is claimed is:

1. Device for attenuating parasitic voltages comprising:

a. a magnetic core comprising a soft magnetic nanocrystalline alloy; and b. at least two reactance coils with multiple windings wound around said magnetic core, wherein along the length of each reactance coil closely-wound winding sections alternate with and are separated only by at least one broadly-wound winding section.

2. Device as in claim 1 in which the magnetic core is an annular core.

3. Device as in claim 2 in which three reactance coils are mounted on the magnetic core.

4. Device as in claim 1 in which the reactance coils are wound in sectors on the magnetic core.

5. Device as in claim 1 in which each reactance coil is wound in multiple layers around the magnetic core.

6. Device for attenuating parasitic voltages comprising:

a. an annular magnetic core (i) comprising a soft magnetic allay and (ii) defining first and second segments of semi-circular cross-section symmetric about an axis; and b. first and second reactance coils each with multiple windings, the first reactance coil wound around the first segment of the magnetic core and the second reactance coil wound around the second segment of the magnetic core, and in which along the length of each of the first and second reactance coils closely-wound winding sections are separated by at least one broadly-wound winding section.

* * * * *